US011443894B2

(12) United States Patent
Lee et al.

(10) Patent No.: US 11,443,894 B2
(45) Date of Patent: Sep. 13, 2022

(54) COIL COMPONENT

(71) Applicant: SAMSUNG ELECTRO-MECHANICS CO., LTD., Suwon-si (KR)

(72) Inventors: Dong Hwan Lee, Suwon-si (KR); Chan Yoon, Suwon-si (KR); Dong Jin Lee, Suwon-si (KR); Young Ghyu Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 400 days.

(21) Appl. No.: 16/783,540

(22) Filed: Feb. 6, 2020

(65) Prior Publication Data

US 2021/0020359 A1 Jan. 21, 2021

(30) Foreign Application Priority Data

Jul. 17, 2019 (KR) ..... 10-2019-0086176

(51) Int. Cl.
*H01F 27/36* (2006.01)
*H01F 27/28* (2006.01)
(Continued)

(52) U.S. Cl.
CPC ..... *H01F 27/36* (2013.01); *H01F 27/24* (2013.01); *H01F 27/2804* (2013.01);
(Continued)

(58) Field of Classification Search
CPC ..... H01F 27/36; H01F 27/24; H01F 27/2804; H01F 27/29; H01F 27/323; H01F 41/041;
(Continued)

(56) References Cited

U.S. PATENT DOCUMENTS 10,204,741 B2 2/2019 Matsunaga
2002/0158306 A1 10/2002 Niitsu
(Continued)

FOREIGN PATENT DOCUMENTS

JP H6-82843 U 11/1994
JP 2002-198490 A 7/2002
(Continued)

OTHER PUBLICATIONS

Office Action issued in corresponding Japanese Patent Application No. 2020-022723 dated Mar. 16, 2021, with English Translation.
(Continued)

*Primary Examiner* — Robert L Deberadinis
(74) *Attorney, Agent, or Firm* — Morgan, Lewis & Bockius LLP

(57) ABSTRACT

A coil component includes a body, a support substrate buried in the body, a coil portion disposed on at least one surface of the support substrate and having both ends exposed to a surface of the body, a noise removing portion disposed on the at least one surface of the support substrate, spaced apart from the coil portion, and forming an open loop such that one end of the noise removing portion is exposed to a surface of the body, an insulating layer disposed between the coil portion and the noise removing portion, first and second external electrodes disposed on a surface of the body and connected to both ends of the coil portion, respectively, and a third external electrode disposed on a surface of the body and connected to the one end of the noise removing portion.

30 Claims, 14 Drawing Sheets

(51) Int. Cl.

| | |
|---|---|
| ***H01F 41/04*** | (2006.01) |
| ***H01F 27/32*** | (2006.01) |
| ***H01F 27/29*** | (2006.01) |
| ***H01F 27/24*** | (2006.01) |

(52) U.S. Cl.
CPC ..... *H01F 27/29* (2013.01); *H01F 27/323* (2013.01); *H01F 41/041* (2013.01); *H01F 2027/2809* (2013.01)

(58) Field of Classification Search
CPC .. H01F 2027/2809; H01F 27/28; H01F 41/04; H01F 27/32
See application file for complete search history.

(56) References Cited

U.S. PATENT DOCUMENTS

| | | | |
|---|---|---|---|
| 2008/0149383 | A1 | 6/2008 | Kaneko et al. |
| 2014/0022041 | A1 | 1/2014 | Park et al. |
| 2017/0063322 | A1 | 3/2017 | Matsunaga |

FOREIGN PATENT DOCUMENTS

| | | | |
|---|---|---|---|
| JP | 2006-179596 | A | 7/2006 |
| JP | 2008-141070 | A | 6/2008 |
| JP | 2009-200151 | A | 9/2009 |
| JP | 2014-22724 | A | 2/2014 |
| JP | 2017-46169 | A | 3/2017 |
| JP | 2018-113432 | A | 7/2018 |
| KR | 10-2017-0026135 | A | 3/2017 |

OTHER PUBLICATIONS

Japanese Office Action dated Nov. 24, 2021 , issued in corresponding Japanese Patent Application No. 2020-022723.

VI-VI'

VII-VII'

COIL COMPONENT

CROSS-REFERENCE TO RELATED APPLICATION(S)

This application claims benefit of priority to Korean Patent Application No. 10-2019-0086176 filed on Jul. 17, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in electronic devices together with a resistor and a capacitor.

As an electronic device has been designed to have high performance and a reduced size, the number of electronic components used in an electronic device has been increased, and the sizes of electric components have been reduced.

Accordingly, there has been increasing demand for removing noise from a coil component, such as electromagnetic interference (EMI).

SUMMARY

An aspect of the present disclosure is to provide a coil component which may easily remove noise.

According to an aspect of the present disclosure, a coil component includes a body; a support substrate buried in the body; a coil portion disposed on at least one surface of the support substrate and having both ends exposed to a surface of the body; a noise removing portion disposed on the at least one surface of the support substrate, spaced apart from the coil portion, and having an open loop such that one end of the noise removing portion is exposed to a surface of the body; an insulating layer disposed between the coil portion and the noise removing portion; first and second external electrodes disposed on a surface of the body and connected to both ends of the coil portion, respectively; and a third external electrode disposed on a surface of the body and connected to the one end of the noise removing portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
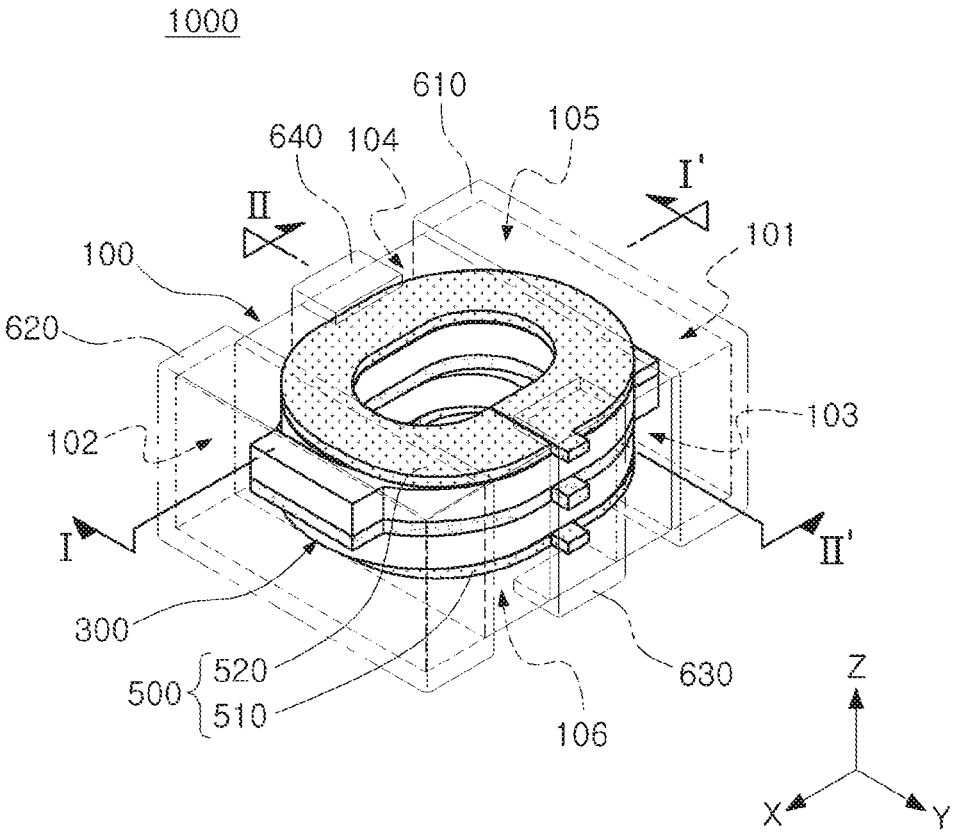
FIG. 1 is a diagram illustrating a coil component according to an example embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment and Modified Examples Thereof

Figure 2:
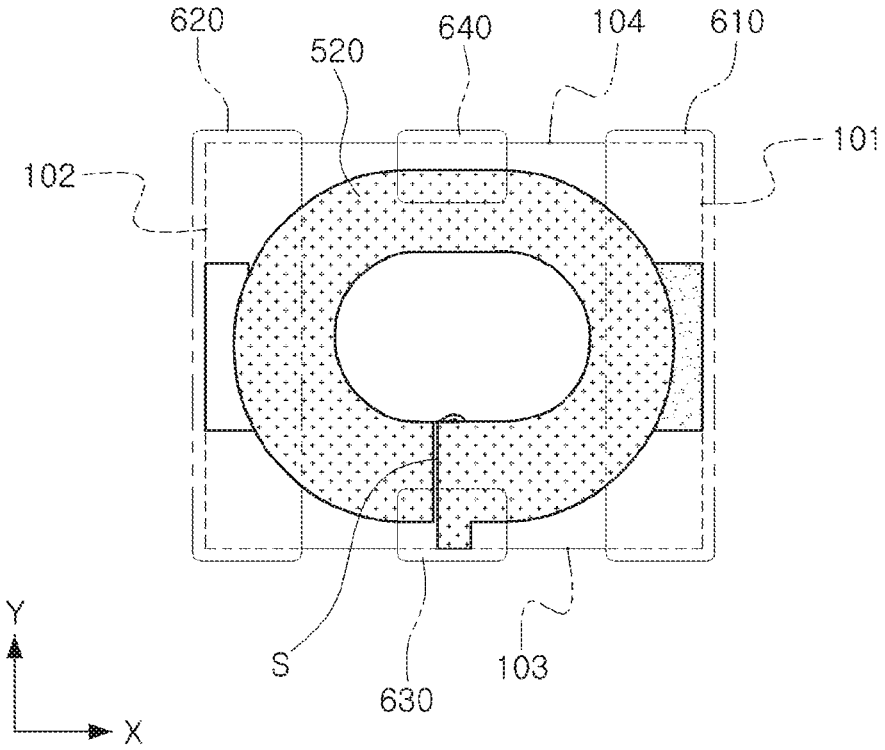
FIG. 2 is a diagram illustrating the coil component illustrated in FIG. 1, viewed from an upper surface.
Figure 3:
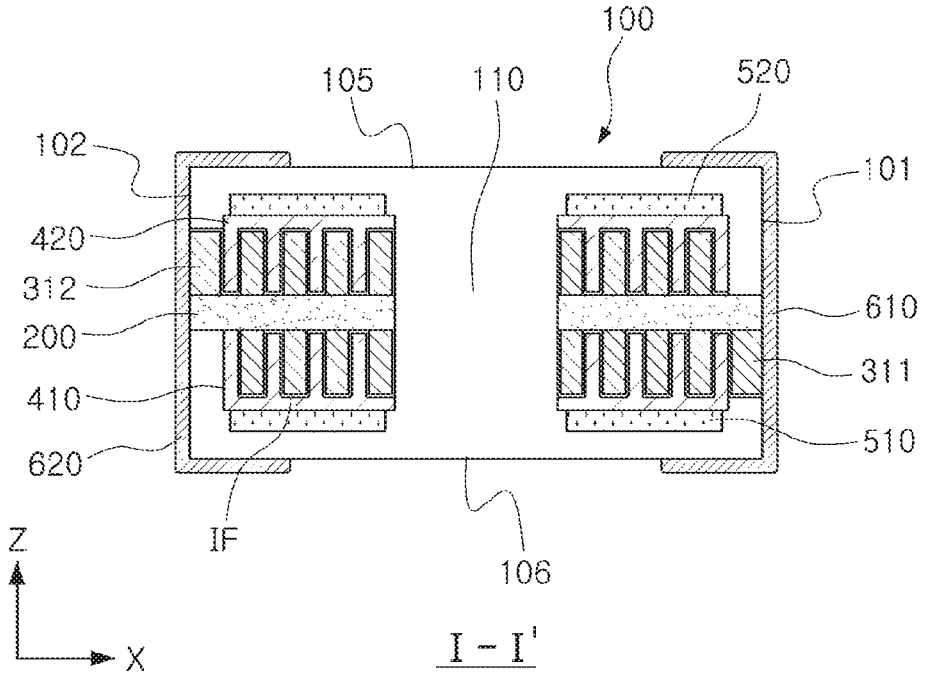
FIG. 3 is a cross-sectional diagram taken along line I-I' in FIG. 1.
Figure 4:
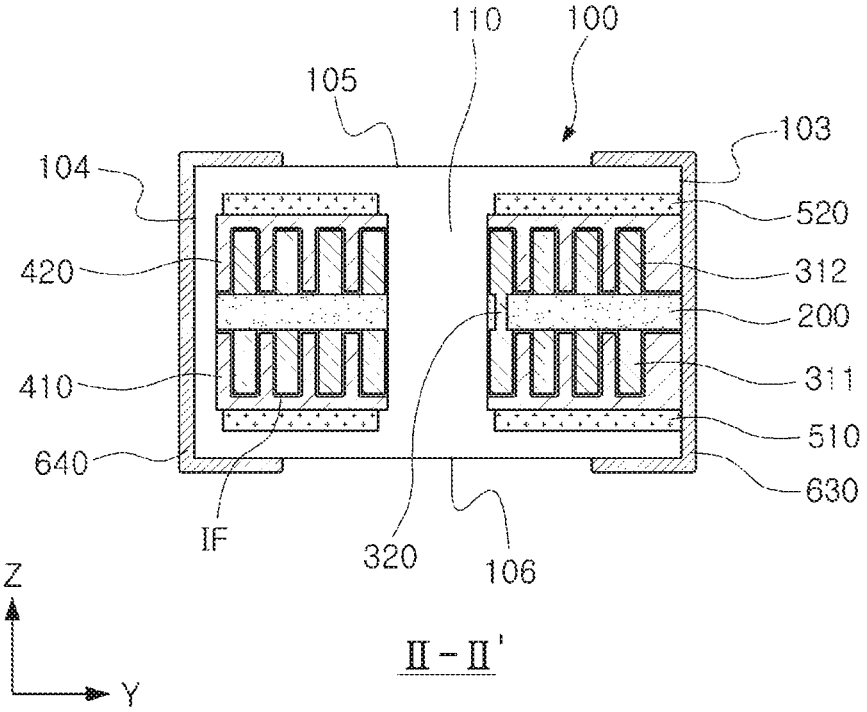
FIG. 4 is a cross-sectional diagram taken along line II-II' in FIG. 1.

FIG. 1 is a diagram illustrating a coil component according to an example embodiment. FIG. 2 is a diagram illustrating the coil component illustrated in FIG. 1, viewed from an upper surface. FIG. 3 is a cross-sectional diagram taken along line I-I' in FIG. 1. FIG. 4 is a cross-sectional diagram taken along line II-II' in FIG. 1. In FIG. 1, an insulating layer applied to the example embodiment is not illustrated to clearly represent combinations between the elements.

Referring to FIGS. 1 to 4, a coil component 1000 in the example embodiment may include a body 100, a support substrate 200, a coil portion 300, insulating layers 410 and 420, a noise removing portion 500, and first to fourth external electrodes 610, 620, 630, and 640, and may further include an insulating film IF.

The body 100 may form an exterior of the coil component 1000 in the example embodiment, and the coil portion 300 may be buried in the body 100.

The body 100 may have a hexahedral shape, for example.

The body 100 may include a first surface 101 and a second surface 102 opposing each other in a length direction X, a third surface 103 and a fourth surface 104 opposing each other in a width direction Y, and a fifth surface 105 and a sixth surface 106 opposing each other in a thickness direction Z. The first to fourth surfaces 101, 102, 103, and 104 of the body 100 may be walls of the body 100 connecting the fifth surface 105 and the sixth surface 106 of the body 100 to each other. In the description below, "front and rear surfaces of the body" may refer to the first surface 101 and the second surface 102, respectively, and "side surfaces of the body" may refer to the third surface 103 and the fourth surface 104 of the body, respectively. Also, "one surface and another surface" of the body 100 may refer to the fifth surface 105 and the sixth surface 106 of the body 100, respectively.

As an example, the body 100 may be configured such that the coil component 1000 in which the external electrodes 610, 620, 630, and 640 are formed may have a length of 2.0 mm, a width of 1.2 mm, and a thickness of 0.65 mm, but an exemplary embodiment thereof is not limited thereto. The above-mentioned sizes are example sizes determined without consideration of a process error, and the like, and an example of the sizes is not limited thereto.

The body 100 may include a magnetic material and a resin material. For example, the body 100 may be formed by layering one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or a magnetic metal powder.

The ferrite may include, for example, one or more materials of a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an exemplary embodiment of the magnetic metal powder is not limited thereto.

The ferrite and the magnetic metal powder may have an average diameter of 0.1 μm to 30 μm, but an example of the average diameter is not limited thereto.

The body 100 may include two or more types of magnetic materials dispersed in a resin. The notion that types of the magnetic materials are different may indicate that one of an average diameter, a composition, a crystallinity, and a form of one magnetic material is different from those of the other magnetic material(s).

The resin may include one of an epoxy, a polyimide, a liquid crystal polymer, or mixture thereof, but the example of the resin is not limited thereto.

The body 100 may include a core 110 penetrating through the coil portion 300 and the support substrate 200. The core 110 may be formed by filling a through hole of the coil portion 300 with a magnetic composite sheet, but an exemplary embodiment thereof is not limited thereto.

The support substrate 200 may be buried in the body 100. The support substrate 200 may support the coil portion 300.

The support substrate 200 may be formed of an insulating material including a thermosetting insulating resin such as an epoxy resin, a thermoplastic insulating resin such as a polyimide, or a photosensitive insulating resin, or may be formed of an insulating material including a reinforcing material such as a glass fiber or an inorganic filler with the above-described insulating resin. For example, the support substrate 200 may be formed of a material such as prepreg, Ajinomoto Build-up Film (ABF), FR-4, a bismaleimide triazine (BT) resin, a photoimageable dielectric (PID), a copper clad laminate (CCL) and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide improved stiffness. When the support substrate 200 is formed of an insulating material which does not include a glass fiber, the support substrate 200 may be desirable to reduce an overall thickness of the coil portion 300.

The coil portion 300 may be buried in the body 100, and may embody properties of the coil component. For example, when the coil component 1000 is used as a power inductor, the coil portion 300 may store an electric field as a magnetic field such that an output voltage may be maintained, thereby stabilizing power of an electronic device.

The coil portion 300 may be formed on at least one of both surfaces of the support substrate 200, and may form at least one turn. In the example embodiment, the coil portion 300 may include first and second coil patterns 311 and 312 formed on both surfaces of the support substrate 200 opposing each other in a thickness direction Z of the body 100, respectively, and a via 320 penetrating the support substrate 200 to connect the first and second coil patterns 311 and 312 to each other.

Each of the first coil pattern 311 and the second coil pattern 312 may have a planar spiral form forming at least one turn with reference to the core 110 as a shaft. As an example, the first coil pattern 311 may form at least one turn with reference to the core 110 as a shaft on a lower surface of the support substrate 200, and the second coil pattern 312 may form at least one turn with reference to the core 110 as a shaft on an upper surface of the support substrate 200, in the direction indicated in FIG. 3.

Ends of the first and second coil patterns 311 and 312 may be connected to the first and second external electrodes 610 and 620, respectively. As an example, an end of the first coil pattern 311 may extend to be exposed to the first surface 101 of the body 100, and an end of the second coil pattern 312 may extend to be exposed to the second surface 102 of the body 100, such that the first and second coil patterns 311 and 312 may be connected to the first and second external electrodes 610 formed on the first and second surfaces 101 and 102 of the body 100, respectively. In this case, each of the coil patterns 311 and 312 including the ends may be formed in integrated form.

At least one of the coil patterns 311 and 312 and the via 320 may include at least one or more conductive layers.

As an example, when the second coil pattern 312 and the via 320 are formed on the other surface of the support substrate 200 by a plating process, each of the second coil pattern 312 and the via 320 may include a seed layer and an electroplating layer. The seed layer may be formed by a vapor deposition process such as an electroless plating process, a sputtering process, and the like. Each of the seed layer and the electroplating layer may have a single layer structure, or a multilayer structure. The electroplating layer having a multilayer structure may be formed in conformal film structure in which an electroplating layer is covered by another electroplating layer, or a structure in which an electroplating layer is only layered on one surface of one of the electroplating layers. A seed layer of the second coil pattern 312 and a seed layer of the via 320 may be integrated with each other such that a boundary may not be formed therebetween, but an example embodiment thereof is not limited thereto. An electroplating layer of the second coil pattern 312 and an electroplating layer of the via 320 may be integrated with each other, such that a boundary may not be formed therebetween, but an example embodiment thereof is not limited thereto.

As another example, with reference to the directions in FIGS. 3 and 4, when the coil portion 300 is formed by separately forming the first coil pattern 311 disposed on a lower surface of the support substrate 200 and the second coil pattern 312 disposed on an upper surface of the support substrate 200 and layering the first coil pattern 311 and the second coil pattern 312 on the support substrate 200, the via 320 may include a metal layer having a high melting point and a metal layer having a low melting point, lower than a melting point of the metal layer having a high melting point. The metal layer having a low melting point may be formed as solder including lead (Pb) and/or tin (Sn). At least a portion of the metal layer having a low melting point may be melted due to pressure and a temperature when the metal layers are layered. Accordingly, an intermetallic compound (IMC) layer may be formed on at least a portion of a boundary between the metal layer having a low melting point and the second coil pattern 312 and a portion of a boundary between the metal layer having a low melting point and the metal layer having a high melting point.

The coil patterns 311 and 312 may be configured to be exposed from a lower surface and an upper surface of the support substrate 200, respectively, in the direction indicated in FIGS. 3 and 4. As another example, the first coil pattern 311 may be formed on and exposed from a lower surface of the support substrate 200, and the second coil pattern 312 may be buried in the support substrate 200, and an upper surface of the second coil pattern 312 may be exposed to an upper surface of the support substrate 200, in the direction indicated in FIGS. 3 and 4. In this case, a concave portion may be formed on the upper surface of the second coil pattern 312, and the upper surface of the support substrate 200 and the upper surface of the second coil pattern 312 may not be coplanar with each other. As another example, the second coil pattern 312 may be formed on and exposed from an upper surface of the support substrate 200, and the first coil pattern 311 may be buried in a lower surface of the support substrate 200, and a lower surface of the first coil pattern 311 may be exposed to a lower surface of the support substrate 200, in the direction in FIGS. 3 and 4. In this case, a concave portion may be formed on the lower surface of the second coil pattern 312, and the lower surface of the support substrate 200 and the lower surface of the second coil pattern 312 may not be coplanar with each other.

The coil patterns 311 and 312 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

The insulating film IF may be formed along surfaces of the first coil pattern 311, the support substrate 200, and the second coil pattern 312. The insulating film IF may protect and insulate the coil patterns 311 and 312, and may include a well-known insulating material such as parylene, or the like. An insulating material included in the insulating film IF is not limited to any particular material. The insulating film IF may be formed by a method such as a vapor deposition method, or the like, but an example of the method is not limited thereto. In the example embodiment, the insulating layers 410 and 420 may be formed on the insulating film IF, and accordingly, the insulating film IF may be disposed between the support substrate 200 and the insulating layers 410 and 420 and between the coil patterns 311 and 312 and the insulating layers 410 and 420.

The insulating layers 410 and 420 may be disposed between the coil portion 300 and the noise removing portion 500. As an example, as illustrated in FIGS. 3 and 4, the first insulating layer 410 may be disposed on the first coil pattern 311, and may be disposed between the first coil pattern 311 and a first noise removing pattern 510 in the example embodiment. The second insulating layer 420 may be disposed on the second coil pattern 312 and may be disposed between the second coil pattern 312 and a second noise removing pattern 520.

The insulating layers 410 and 420 may be formed by layering insulating films on both surfaces of the support substrate 200 on which the coil portion 300 and the insulating film IF are formed. The insulating film may be implemented by a general non-photosensitive insulating film such as Ajinomoto build-up film (ABF), prepreg, and the like, or a photosensitive insulating film such as a dry-film or a PID. The insulating layers 410 and 420 may function as dielectric layers in relation to capacitive coupling between the coil patterns 311 and 312 of the coil portion 300 and the noise removing patterns 510 and 520 of the noise removing portion 500. For example, the insulating layers 410 and 420 may be composed of a dielectric material. In this case, the insulating layers 410 and 420 may not include a magnetic material.

The noise removing portion 500 may be disposed in the body 100 to emit noise transferred to components and/or noise generated from components to a substrate on which the coil component is mounted. For example, the noise removing portion 500 may be buried in the body 100, may be disposed on the coil portion 300, and may form an open loop such that one end of the noise removing portion 500 may be exposed to a surface of the body 100. In the example embodiment, the first noise removing pattern 510 may be disposed on the first insulating layer 410 and may be disposed on the first coil pattern 311, and the second noise removing pattern 520 may be disposed on the second insulating layer 420 and may be disposed on the second coil pattern 312. The noise removing portion 500 including the first and second noise removing patterns 510 and 520 may be capacitively-coupled to the coil portion 300 by means of the insulating layers 410 and 420.

The noise removing portion 500 may form an open loop. For example, each of the first and second noise removing patterns 510 and 520 may be disposed such that the other end extending from one end exposed to the third surface of the body 100 may be spaced apart from the one end. Thus, in the example embodiment, each of the first and second noise removing patterns 510 and 520 may have a ring shape including a slit S formed therein, corresponding to the first and second coil patterns 311 and 312. The slit S may extend in a direction crossing adjacent turns. For example, the slit S may linearly extend in a direction perpendicular to, or substantially perpendicular to, the third or fourth surface 103 or 104.

Each of the first and second noise removing patterns 510 and 520 may be disposed to correspond to a region in which the coil portion 300 is disposed. As an example, referring to FIGS. 1, 2, and 4, a value of a line width of a region of the second noise removing pattern 520 disposed on the third surface 103 of the body 100 may be similar to, or substantially equal to, a value of a distance between an innermost turn and an outermost turn of the second coil pattern 312 in a region disposed on the third surface 103. As the noise removing portion 500 is disposed in a region corresponding to the coil portion 300, noise may be easily removed, and a decrease in magnetic material in the body 100 may be significantly reduced. Accordingly, degradation of properties of the component caused by a decrease in magnetic material may be significantly prevented.

One end of the noise removing portion 500 may be exposed to the third surface 103 of the body 100. One end of the noise removing portion 500 may be connected to the third external electrode 630 disposed on the third surface 103 of the body 100. For example, in the example embodiment, one ends of the first and second noise removing patterns 510 and 520 may be exposed to the third surface 103 of the body 100 and may be connected to the third external electrode 630. When the coil component 1000 is mounted on a substrate, the third external electrode 630 may be connected to a ground of the substrate, and when the coil component 1000 is packaged into an electronic component package, the third external electrode 630 may be connected to a ground of the electronic component package. In the example embodiment, the fourth external electrode 640 disposed on the fourth surface 104 of the body 100 may be included, and the fourth external electrode 640 may be used as a non-contact terminal (e.g., the fourth external electrode 640 may be spaced apart from the noise removing patterns 500 and the coil portion 300) and may be connected to a ground of a substrate on which the coil component is mounted, or may be connected to a ground of a package. In one example, the support substrate 200 may include an end, overlapping the one end of the noise removing portion 500 in the thickness direction Z. The end of the support substrate 200, similar to the one end of the noise removing portion 500, may be exposed from the third surface 103 and connected to the third external electrode 630.

The noise removing patterns 510 and 520 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto. In one example, each of the noise removing patterns 510 and 520 may include an electrically conductive layer. The noise removing patterns 510 and 520 and the slit S may be formed by a method including at least one of a vapor deposition process such as an electroless plating process, an electroplating process, a sputtering process, and an etching process, but an example of the method is not limited thereto.

The first and second external electrodes 610 and 620 may be disposed on the first and second surfaces 101 and 102 of the body 100, respectively, and may be connected to the first and second coil patterns 311 and 312, respectively. Accordingly, the first external electrode 610 may be disposed on the first surface 101 of the body 100 and may be in contact with and connected to an end of the first coil pattern 311 exposed to the first surface 101 of the body 100. The second external electrode 620 may be disposed on the second surface 102 of the body 100 and may be in contact with and connected to an end of the second coil pattern 312 exposed to the second surface 102 of the body 100. The first and second external electrodes 610 and 620 may extend to the sixth surface 106 of the body 100 from the first and second surfaces 101 and 102 of the body 100, respectively. The first and second external electrodes 610 and 620 may extend to a portion of each of the third, fourth, and fifth surfaces 103, 104, and 105 of the body 100 from the first and second surfaces 101 and 102 of the body 100, respectively. Forms of the first and second external electrodes 610 and 620 illustrated in FIG. 1 and the other diagrams are merely examples, and alternatively, each of the external electrodes 610 and 620 may be configured to not extend to a portion of each of the third, fourth, and fifth surfaces 103, 104, and 105 of the body 100 and may have an L-shaped form, and various other forms.

When the coil component 1000 is mounted on a substrate such as a printed circuit board, or the like, the first and second external electrodes 610 and 620 may electrically connect the coil component 1000 to the substrate. For example, the coil component 1000 in the example may be mounted such that the sixth surface 106 of the body 100 may be oriented to face an upper surface of a printed circuit board, and the external electrodes 610 and 620 extended to the sixth surface 106 of the body 100 may be electrically connected to a connection portion of the printed circuit board by a conductive coupling member such as solder, or the like.

The first to fourth external electrodes 610, 620, 630, and 640 may include at least one of a conductive resin layer and an electroplating layer. The conductive resin layer may be formed by printing a paste, or the like, and may include one or more conductive metals selected from a group consisting of copper (Cu), nickel (Ni), and silver (Ag), and a thermosetting region. The electroplating layer may include one or more selected from a group consisting of nickel (Ni), copper (Cu), and tin (Sn).

Figure 15:
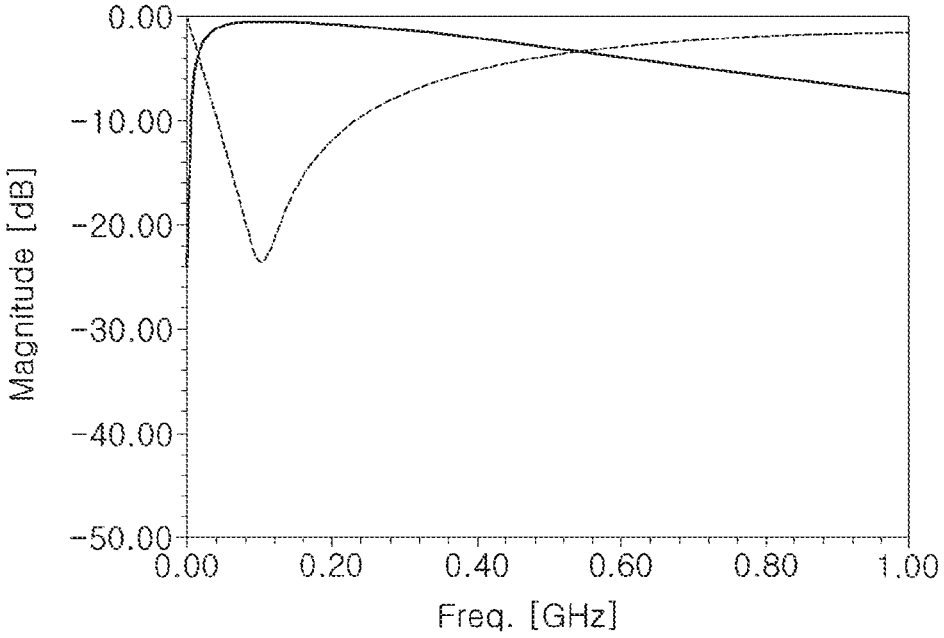
FIG. 15 is a diagram illustrating signal transmission properties (S-parameters) of a coil component in prior art.
Figure 16:
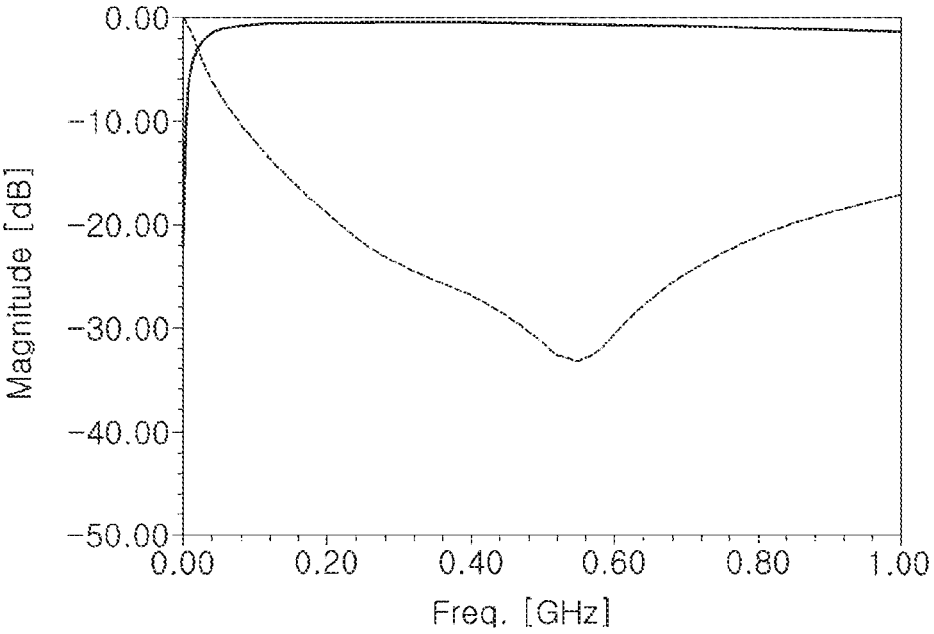
FIG. 16 is a diagram illustrating signal transmission properties (S-parameters) of a coil component according to an example embodiment of the present disclosure.
Figure 18:
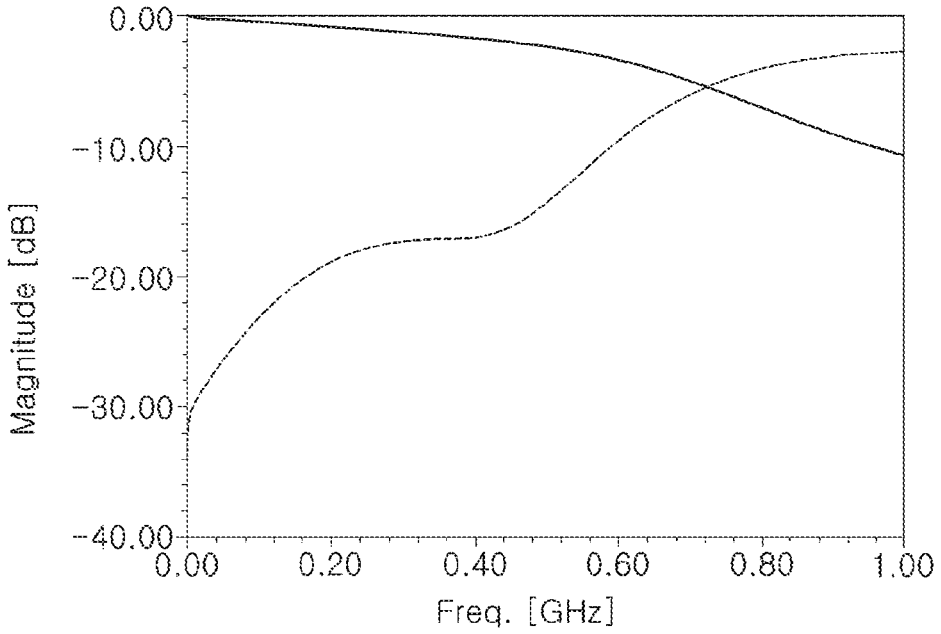
FIG. 18 is a diagram illustrating signal transmission properties (S-parameters) of a coil component including a noise removing portion having a closed-loop form.

FIG. 15 is a diagram illustrating signal transmission properties (S-parameters) of a coil component in prior art. FIG. 16 is a diagram illustrating signal transmission properties (S-parameters) of a coil component according to an example embodiment. FIG. 18 is a diagram illustrating signal transmission properties (S-parameters) of a coil component including a noise removing portion having a closed-loop form. In FIGS. 15, 16, and 18, a solid line indicates an input reflective coefficient, S11, and a dotted line indicates a transmission coefficient from an input terminal to an output terminal, S21. Referring to FIG. 15, differently from the example embodiment, a general coil component in which a noise removing portion is not formed may smoothly transmit a low frequency signal from a direct current, but in a frequency higher than a resonance frequency, a self-resonance frequency (SRF), an effect of removing noise may significantly degrade. Referring to FIG. 16, the coil component 1000 in the example embodiment may relatively smoothly transmit a low frequency signal from a direct current similarly to a general coil component, and may effectively prevent unnecessary high frequency noise as compared to a general coil component. Referring to FIG. 18, when a noise removing portion forms a closed-loop differently from the example embodiment, noise may not be properly emitted externally, and accordingly, an effect of removing noise may degrade.

Figure 5:
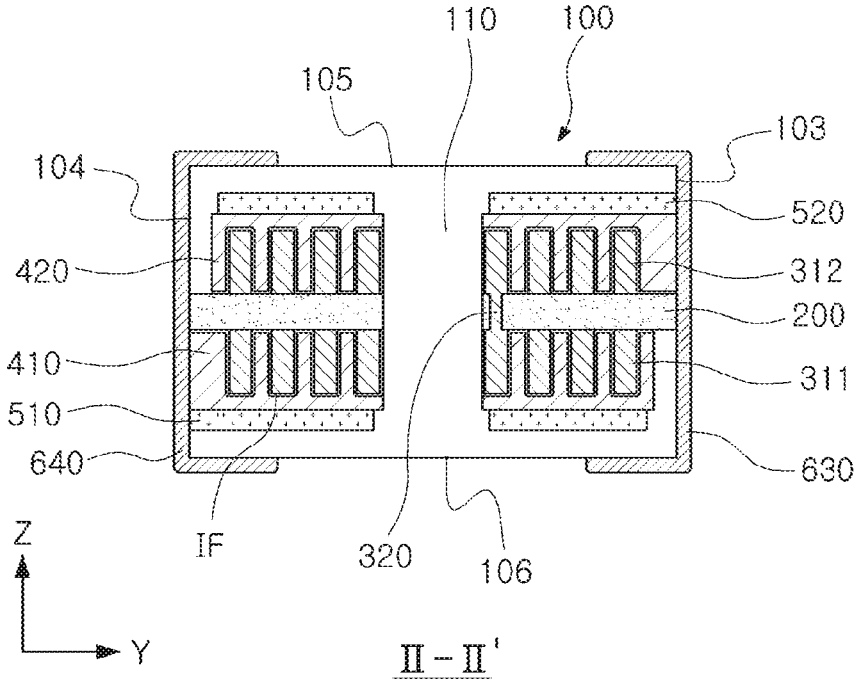
FIG. 5 is a diagram illustrating a coil component according to a modified example, corresponding to a cross-sectional surface taken along line II-II' in FIG. 1.
Figure 6:
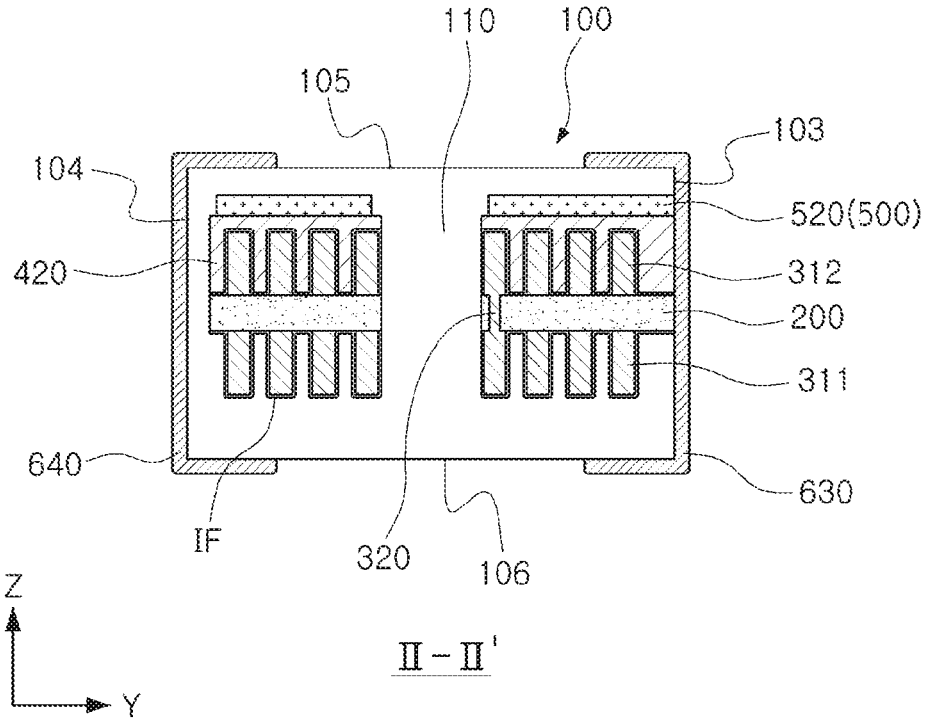
FIG. 6 is a diagram illustrating a coil component according to another modified example, corresponding to a cross-sectional surface taken along line II-II' in FIG. 1.
Figure 7:
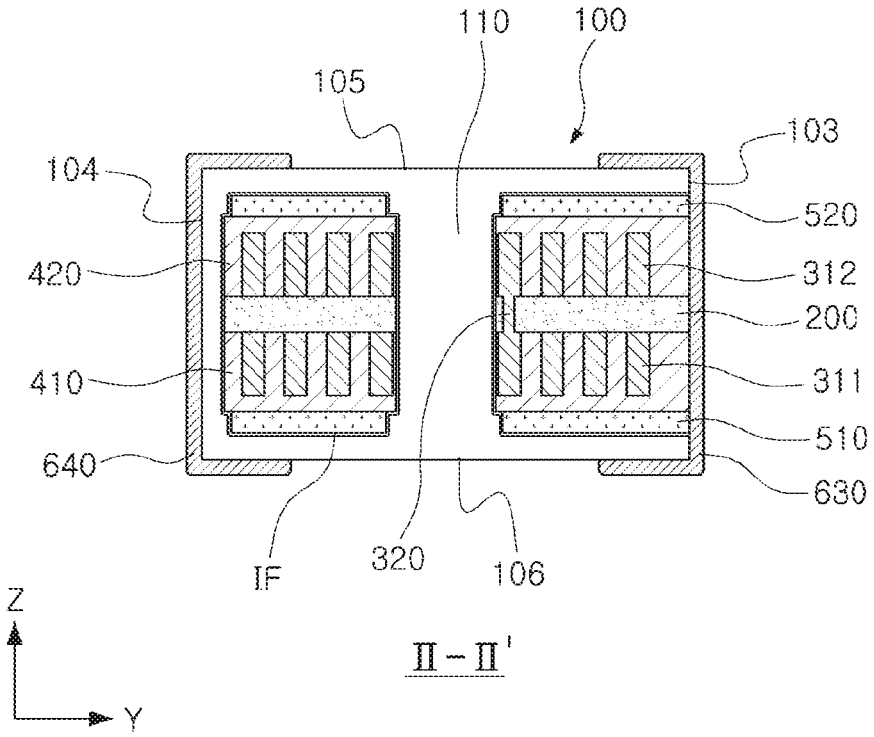
FIG. 7 is a diagram illustrating a coil component according to another modified example, corresponding to a cross-sectional surface taken along line II-II' in FIG. 1.

FIG. 5 is a diagram illustrating a coil component according to a modified example, corresponding to a cross-sectional surface taken along line II-II' in FIG. 1. FIG. 6 is a diagram illustrating a coil component according to another modified example, corresponding to a cross-sectional surface taken along line II-II' in FIG. 1. FIG. 7 is a diagram illustrating a coil component according to another modified example, corresponding to a cross-sectional surface taken along line II-II' in FIG. 1.

Referring to FIG. 5, in the example embodiment, one end of a first noise removing pattern 510 may be exposed to a fourth surface 104 of a body 100, and one end of a second noise removing pattern 520 may be exposed to a third surface 103 of the body 100. One end of the first noise removing pattern 510 may be in contact with and connected to a fourth external electrode 640 disposed on the fourth surface 104 of the body 100, and one end of the second noise removing pattern 520 may be in contact with and connected to a third external electrode 630 disposed on the third surface 103 of the body 100. Thus, in the example embodiment, even when one of the third and fourth external electrodes 630 and 640 connected to a ground of a substrate on which the coil component is mounted, or the like, is disconnected from the substrate, noise may be removed.

Referring to FIG. 6, in the example embodiment, noise removing portions 500 and 520 may be only disposed on a second coil pattern 312. When it is not necessary to remove noise, the noise removing portion may be selectively formed on one of both surfaces of a support substrate 200, and accordingly, material costs may be reduced, and by increasing a content of a magnetic material included in a component having the same size, component properties may improve. Optionally or alternatively, the coil component may further include the insulating layer 410 (not shown in FIG. 6) described above.

Referring to FIG. 7, in the example embodiment, an insulating film IF may be formed along surfaces of a support substrate 200, coil patterns 311 and 312, insulating layers 410 and 420, and noise removing patterns 510 and 520. In the example embodiment, a time point at which the insulating film IF is formed may be different from the aforementioned example embodiment. Accordingly, in the example embodiment, the insulating film IF may be formed by forming the coil patterns 311 and 312, insulating layers 410 and 420, and noise removing patterns 510 and 520 on the support substrate 200 and performing a trimming process. In the example embodiment, the number of trimming process may be reduced as compared to the aforementioned example embodiment.

Second Example Embodiment and Modified Examples Thereof

Figure 8:
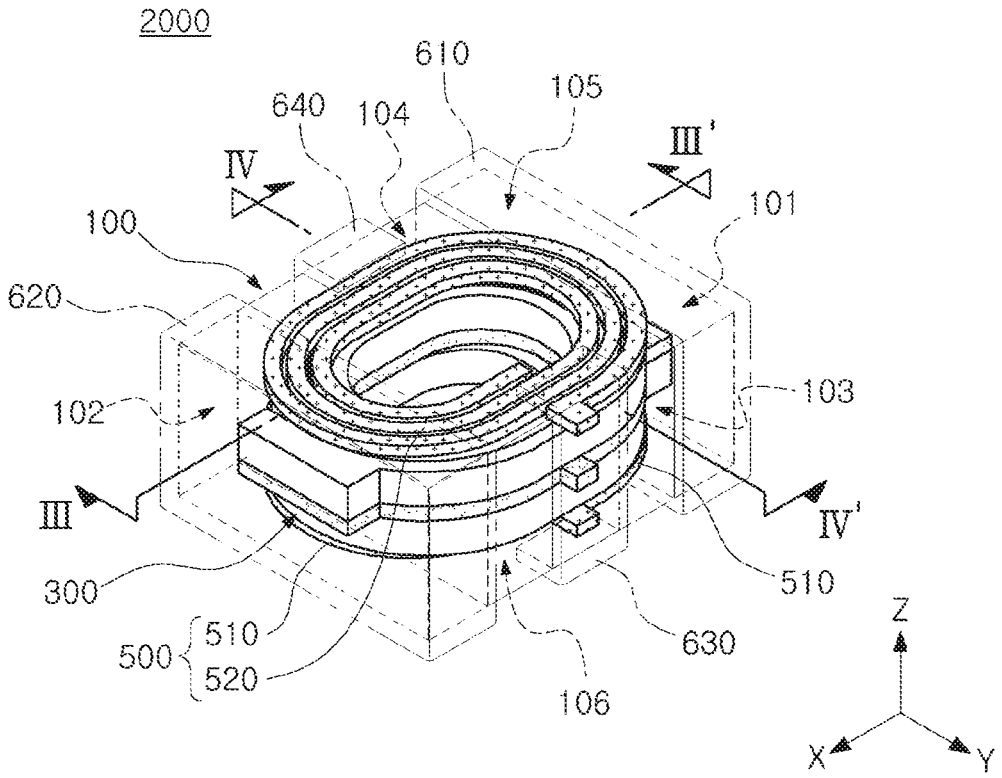
FIG. 8 is a diagram illustrating a coil component according to another example embodiment of the present disclosure.
Figure 9:
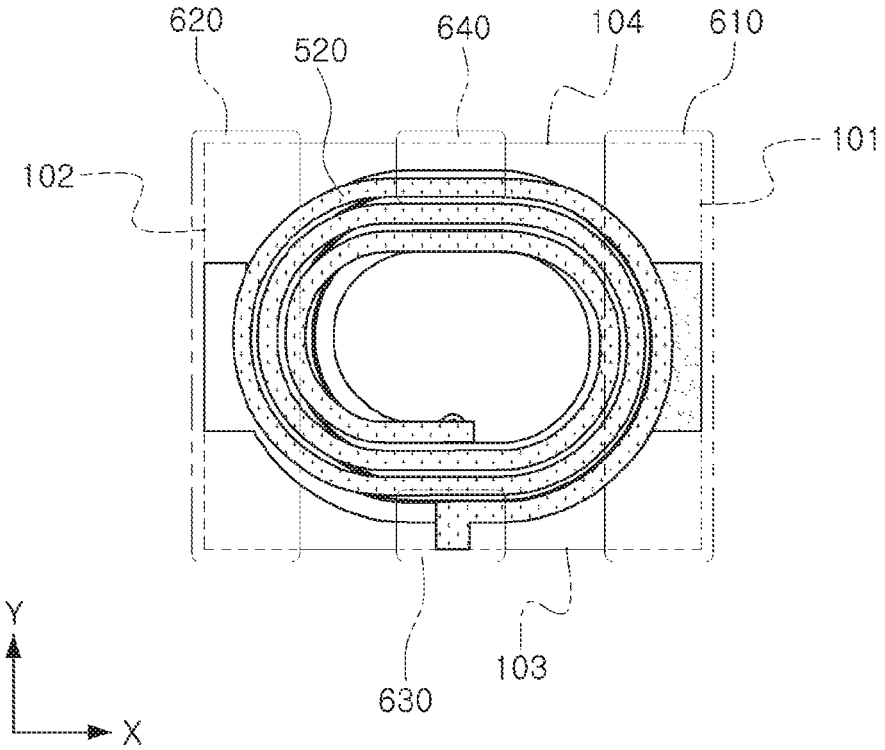
FIG. 9 is a diagram illustrating the coil component illustrated in FIG. 8, viewed from an upper surface.
Figure 10:
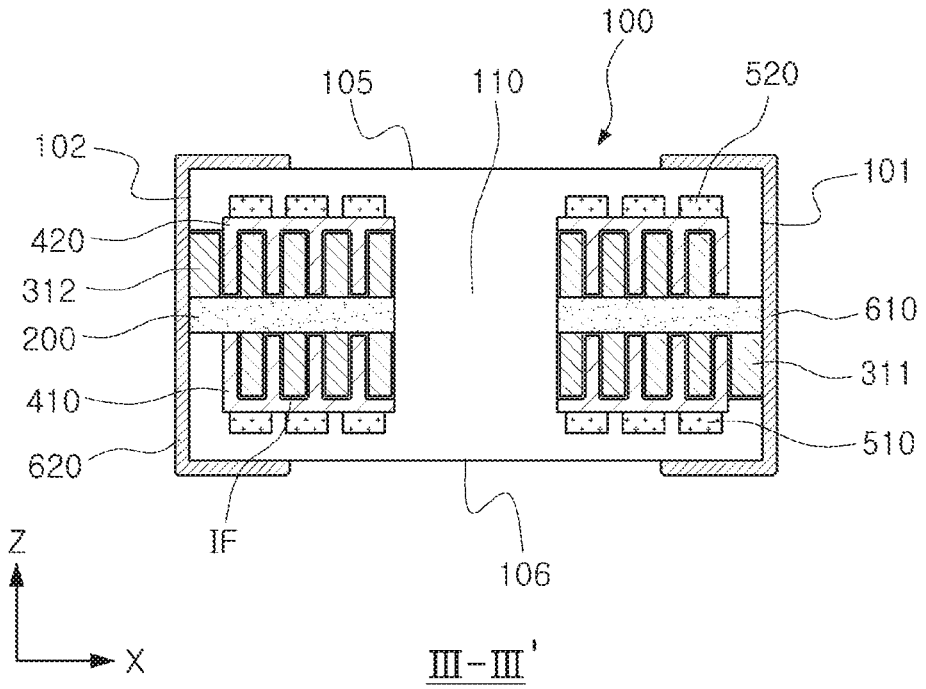
FIG. 10 is a cross-sectional diagram taken along line in FIG. 8.
Figure 11:
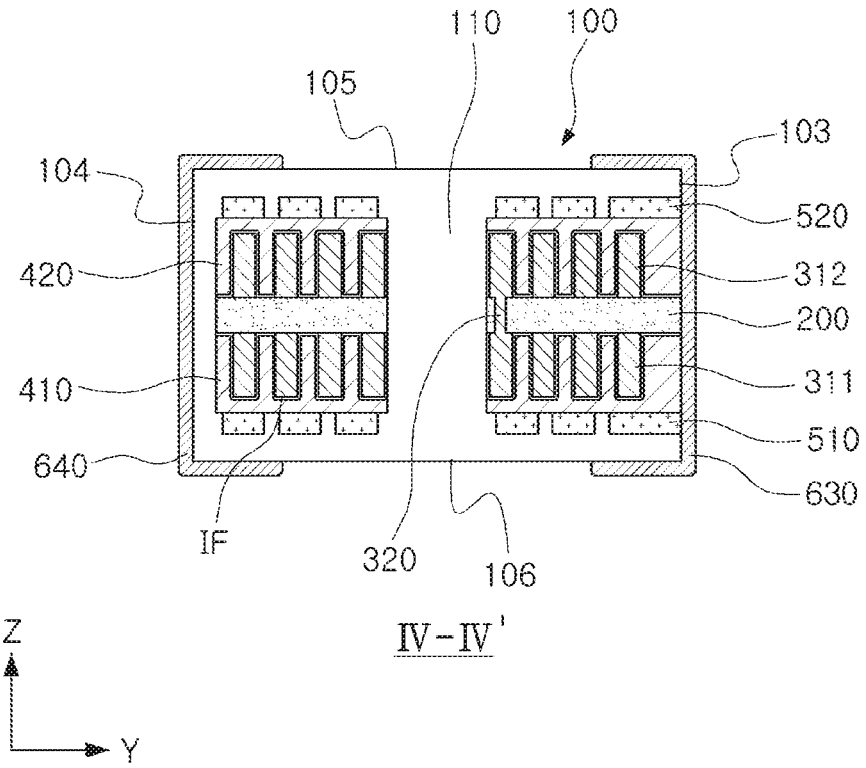
FIG. 11 is a cross-sectional diagram taken along line IV-IV' in FIG. 8.

FIG. 8 is a diagram illustrating a coil component according to another example embodiment. FIG. 9 is a diagram illustrating the coil component illustrated in FIG. 8, viewed from an upper surface. FIG. 10 is a cross-sectional diagram taken along line in FIG. 8. FIG. 11 is a cross-sectional diagram taken along line IV-IV' in FIG. 8. In FIG. 8, an insulating layer applied to the example embodiment is not illustrated to clearly represent combinations between the elements.

Referring to FIGS. 1 to 4 and FIGS. 8 to 11, in a coil component 2000 in the example embodiment, a shape of a noise removing portion 500 may be different from that of the noise removing portion 500 of the coil component 1000 described in the aforementioned example embodiment. Thus, in the example embodiment, only the noise removing portion 500 will be described. The descriptions of the other elements in the example embodiment may be the same as the descriptions of the elements in the aforementioned example embodiment.

Referring to FIGS. 8 to 11, the noise removing portion 500 in the example embodiment may be formed in planar spiral form. Accordingly, each of first and second noise removing patterns 510 and 520 may have a planar spiral form, and may have a plurality of turns similarly to first and second coil patterns 311 and 312.

In this case, a coil portion 300 and a noise removing portion 500 may have the same coiling direction from an innermost turn to an outermost turn. As an example, viewed from an upper surface in the direction indicated in FIG. 8, a coiling direction from an innermost turn to an outermost turn of the second coil pattern 312 may be the same as a coiling direction from an innermost turn to an outermost turn of the second noise removing pattern 520. Also, viewed from a lower surface in the direction indicated in FIG. 8, a coiling direction from an innermost turn to an outermost turn of the first coil pattern 311 may be the same as a coiling direction from an innermost turn to an outermost turn of the first noise removing pattern 510. When the coiling directions of the first and second noise removing patterns 510 and 520 are different from the coiling directions of the first and second coil patterns 311 and 312, an effect of removing noise may degrade.

Figure 17:
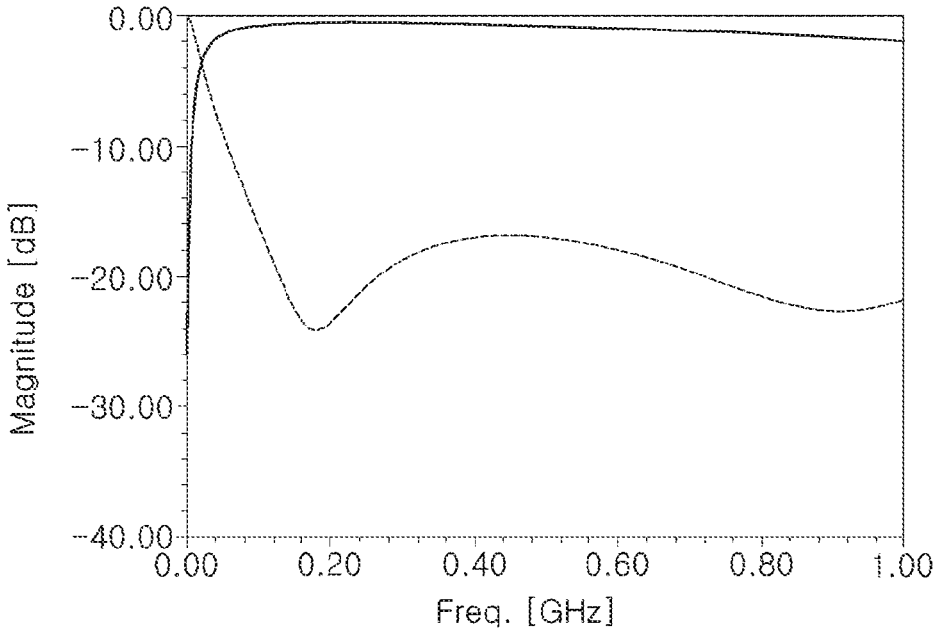
FIG. 17 is a diagram illustrating signal transmission properties (S-parameters) of a coil component according to another example embodiment of the present disclosure.

FIG. 17 is a diagram illustrating signal transmission properties (S-parameters) of a coil component according to another example embodiment of the present disclosure. In FIG. 17, a solid line indicates an input reflective coefficient, S11, and a dotted line indicates a transmission coefficient from an input terminal to an output terminal, S21. Referring to FIG. 15, differently from the example embodiment, a general coil component in which a noise removing portion is not formed may smoothly transmit a low frequency signal from a direct current, but at a frequency higher than a resonance frequency, a self-resonance frequency (SRF), an effect of removing noise may significantly degrade. Differently from a general coil component, referring to FIG. 17, the coil component 2000 in the example embodiment may relatively smoothly transmit a low frequency signal from a direct current similarly to a general coil component, and may effectively prevent unnecessary high frequency noise as compared to a general coil component. Referring to FIG. 18, when a noise removing portion forms a closed-loop differently from the example embodiment, noise may not be properly emitted externally, and accordingly, an effect of removing noise may degrade.

Figure 12:
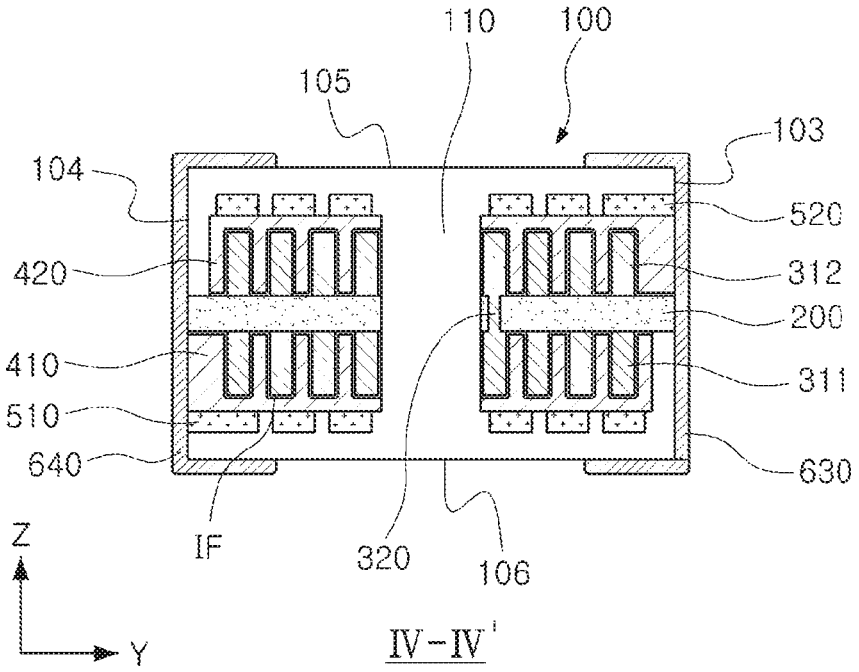
FIG. 12 is a diagram illustrating a coil component according to a modified example, corresponding to a cross-sectional surface taken along line IV-IV' in FIG. 8.
Figure 13:
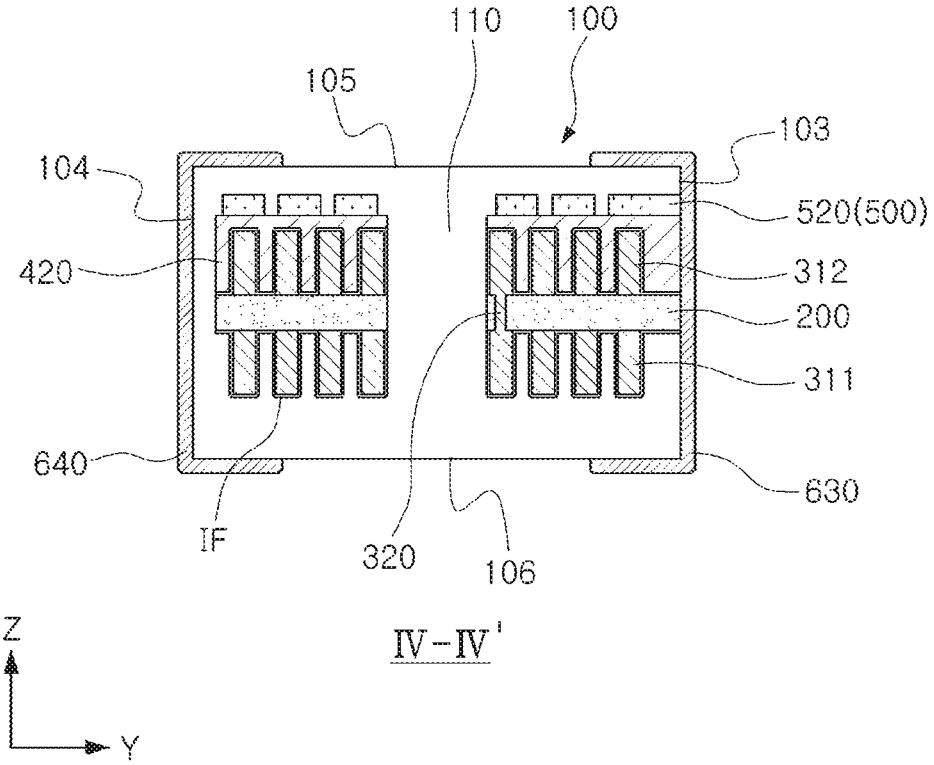
FIG. 13 is a diagram illustrating a coil component according to another modified example, corresponding to a cross-sectional surface taken along line IV-IV' in FIG. 8.
Figure 14:
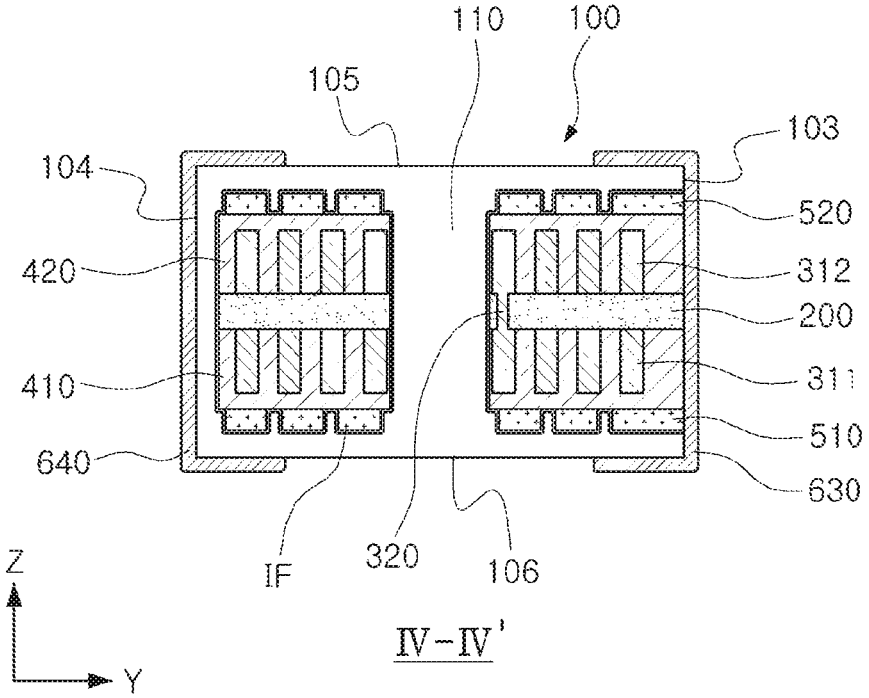
FIG. 14 is a diagram illustrating a coil component according to another modified example, corresponding to a cross-sectional surface taken along line IV-IV' in FIG. 8.

FIG. 12 is a diagram illustrating a coil component according to a modified example, corresponding to a cross-sectional surface taken along line IV-IV' in FIG. 8. FIG. 13 is a diagram illustrating a coil component according to another modified example, corresponding to a cross-sectional surface taken along line IV-IV' in FIG. 8. FIG. 14 is a diagram illustrating a coil component according to another modified example, corresponding to a cross-sectional surface taken along line IV-IV' in FIG. 8.

Referring FIG. 12, in the example embodiment, one end of a first noise removing pattern 510 may be exposed to a fourth surface 104 of a body 100, and one end of a second noise removing pattern 520 may be exposed to a third surface 103 of the body 100. One end of the first noise removing pattern 510 may be in contact with and connected to a fourth external electrode 640 disposed on the fourth surface 104 of the body 100, and one end of the second noise removing pattern 520 may be in contact with and connected to a third external electrode 630 disposed on the third surface 103 of the body 100. Thus, in the example embodiment, even when one of the third and fourth external electrodes 630 and 640 connected to a ground of a substrate on which the coil component is mounted, or the like, is disconnected from the substrate, noise may be removed.

Referring to FIG. 13, in the example embodiment, noise removing portions 500 and 520 may be only disposed on a second coil pattern 312. When it is not necessary to remove noise, the noise removing portion may be selectively formed on one of both surfaces of a support substrate 200, and accordingly, material costs may be reduced, and by increasing a content of a magnetic material included in a component having the same size, component properties may improve. Optionally or alternatively, the coil component may further include the insulating layer 410 (not shown in FIG. 13) described above.

Referring to FIG. 14, in the example embodiment, an insulating film IF may be formed along surfaces of a support substrate 200, coil patterns 311 and 312, insulating layers 410 and 420, and noise removing patterns 510 and 520. In the example embodiment, a time point at which the insulating film IF is formed may be different from the aforementioned example embodiment. Accordingly, in the example embodiment, the insulating film IF may be formed by forming the coil patterns 311 and 312, insulating layers 410 and 420, and noise removing patterns 510 and 520 and performing a trimming process. In the example embodiment, the number of trimming process may be reduced as compared to the aforementioned example embodiment.

Third Example Embodiment and Modified Examples Thereof

Figure 19:
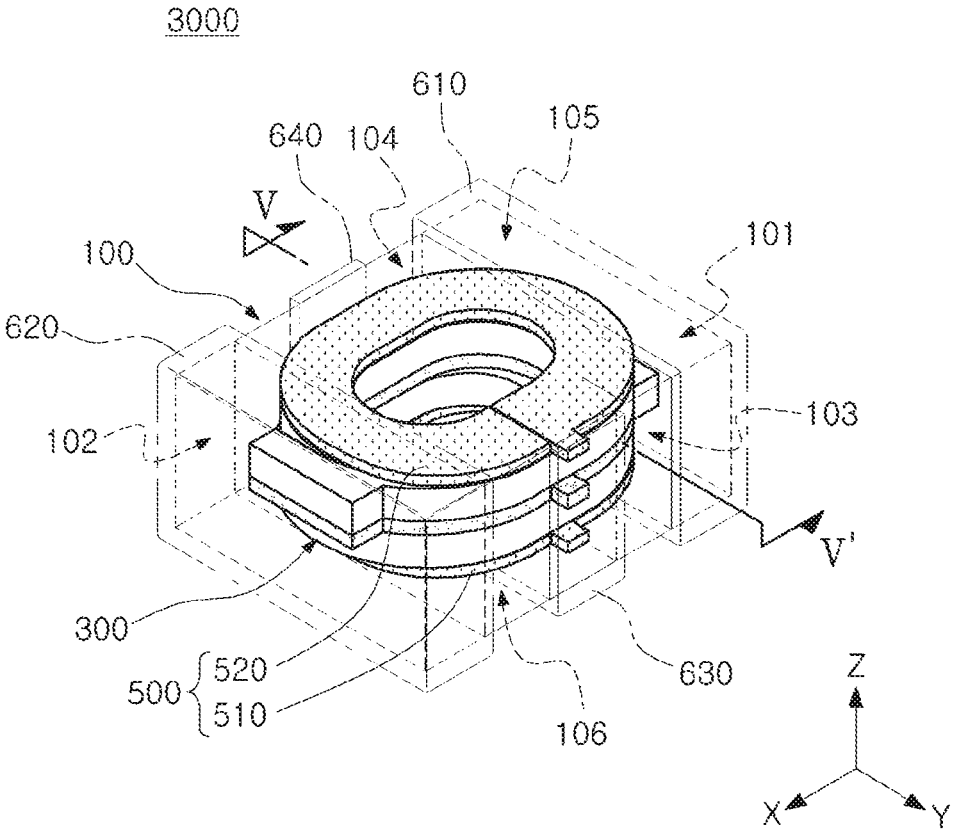
FIG. 19 is a diagram illustrating a coil component according to another example embodiment of the present disclosure.
Figure 20:
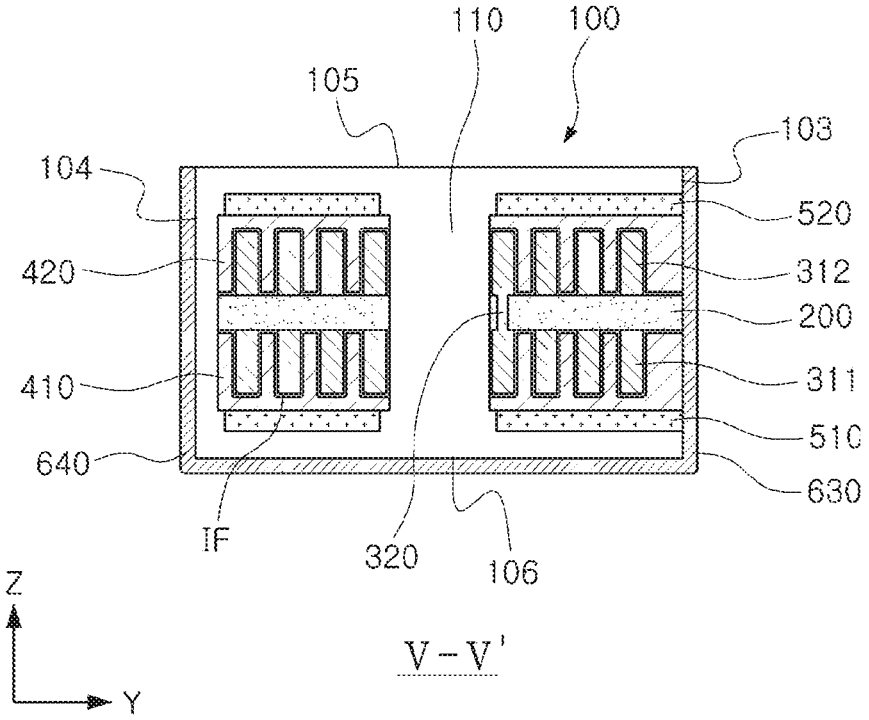
FIG. 20 is a cross-sectional diagram taken along line V-V' in FIG. 19.

FIG. 19 is a diagram illustrating a coil component according to another example embodiment. FIG. 20 is a cross-sectional diagram taken along line V-V' in FIG. 19. In FIG. 19, an insulating layer applied to the example embodiment is not illustrated to clearly represent combinations between the elements.

Referring to FIGS. 1 to 4 and FIGS. 19 and 20, in a coil component 3000, shapes of third and fourth external electrodes 630 and 640 in the example embodiment may be different from those of the third and fourth external electrodes 630 and 640 described in the aforementioned example embodiment. Thus, in the example embodiment, only the third and fourth external electrodes 630 and 640 will be described. The descriptions of the other elements in the example embodiment may be the same as the descriptions of the elements in the aforementioned example embodiment.

Referring to FIGS. 19 and 20, the third and fourth external electrodes 630 and 640 in the example embodiment may be connected to each other on a sixth surface 106 of a body 100.

For example, an end of the third external electrode 630 extended to the sixth surface 106 of the body 100 may be in contact with and connected to an end of the fourth external electrode 640 extended to the sixth surface 106 of the body 100. When the coil component 3000 in the example embodiment is mounted on a substrate such as a printed circuit board, the sixth surface 106 of the body 100 may be a mounting surface. A plurality of signal pads and a plurality of ground pads may be formed on a surface of the substrate on which the coil component is mounted to be connected to other components. In the example embodiment, by configuring the third and fourth external electrodes 630 and 640 to be connected to each other on the sixth surface 106 of the body 100, a ground pad of the substrate on which the coil component is mounted may be easily connected to first and second noise removing patterns 510 and 520. Accordingly, a mounting process may be easily performed.

Figure 21:
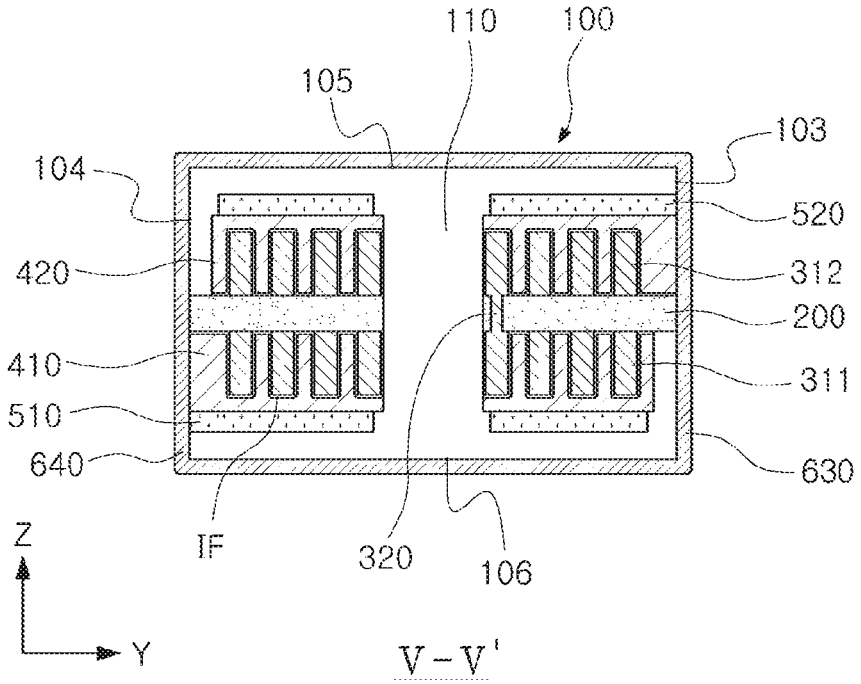
FIG. 21 is a diagram illustrating a coil component according to a modified example, corresponding to a cross-sectional surface taken along line V-V' in FIG. 19.

FIG. 21 is a diagram illustrating a coil component according to a modified example, corresponding to a cross-sectional surface taken along line V-V' in FIG. 19.

Referring to FIG. 21, third and fourth external electrodes 630 and 640 in the example embodiment may be configured to surround third, fourth, fifth, and sixth surfaces 103, 104, 105, and 106 of a body 100. In the example embodiment, the third and fourth external electrodes 630 and 640 connected to noise removing patterns 510 and 520 may be easily formed on a surface of the body 100. In other words, the third and fourth external electrodes 630 and 640 may be easily formed by a printing method such as a screen-printing process, or the like. Even when the third and fourth external electrodes 630 and 640 are formed by a plating process, by patterning a plating resist in a simplified manner, the third and fourth external electrodes 630 and 630 may be easily formed.

Although not illustrated, the example embodiment may also be modified as the aforementioned example embodiments.

Fourth Example Embodiment

Figure 22:
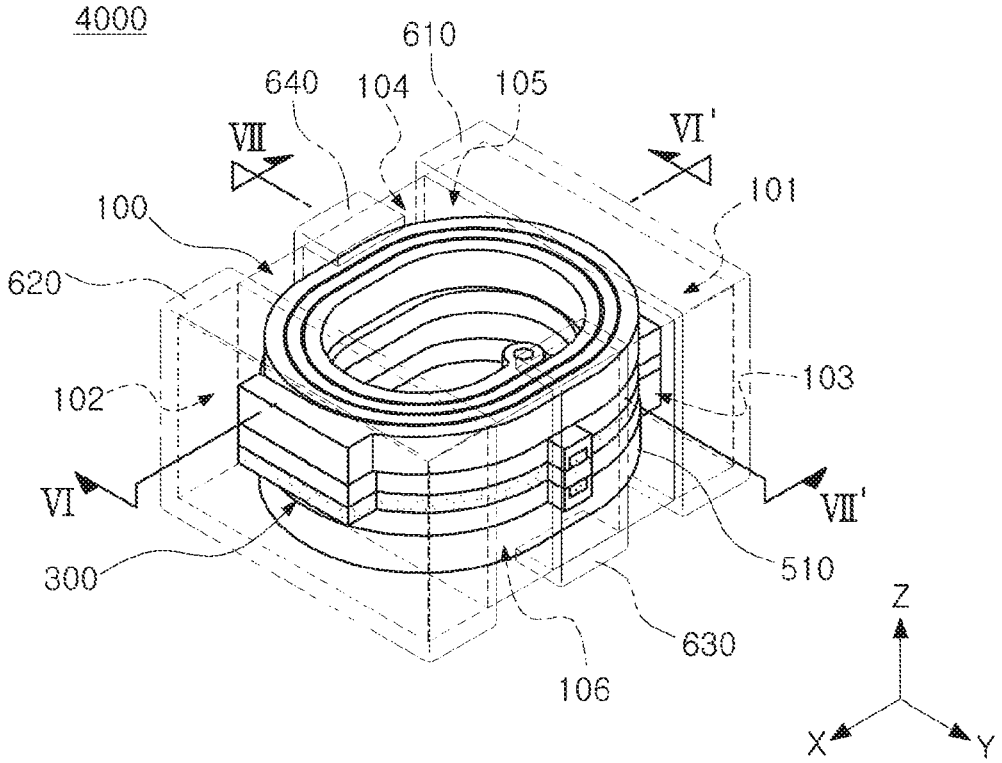
FIG. 22 is a diagram illustrating a coil component according to another example embodiment of the present disclosure.
Figure 23:
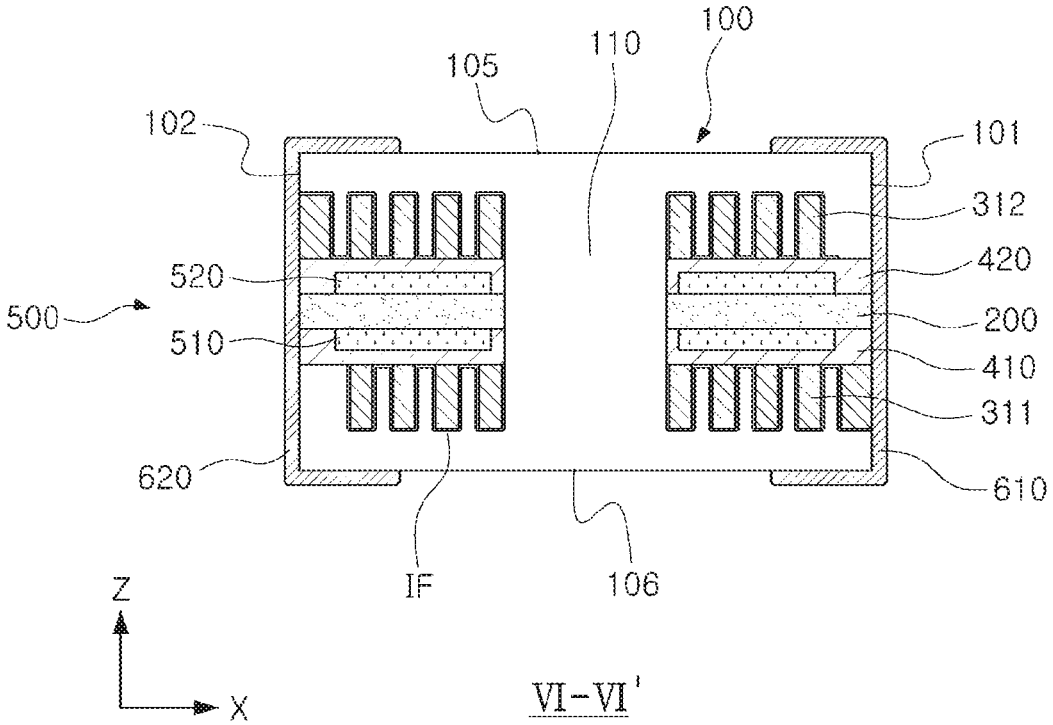
FIG. 23 is a cross-sectional diagram taken along line VI-VI' in FIG. 22.
Figure 24:
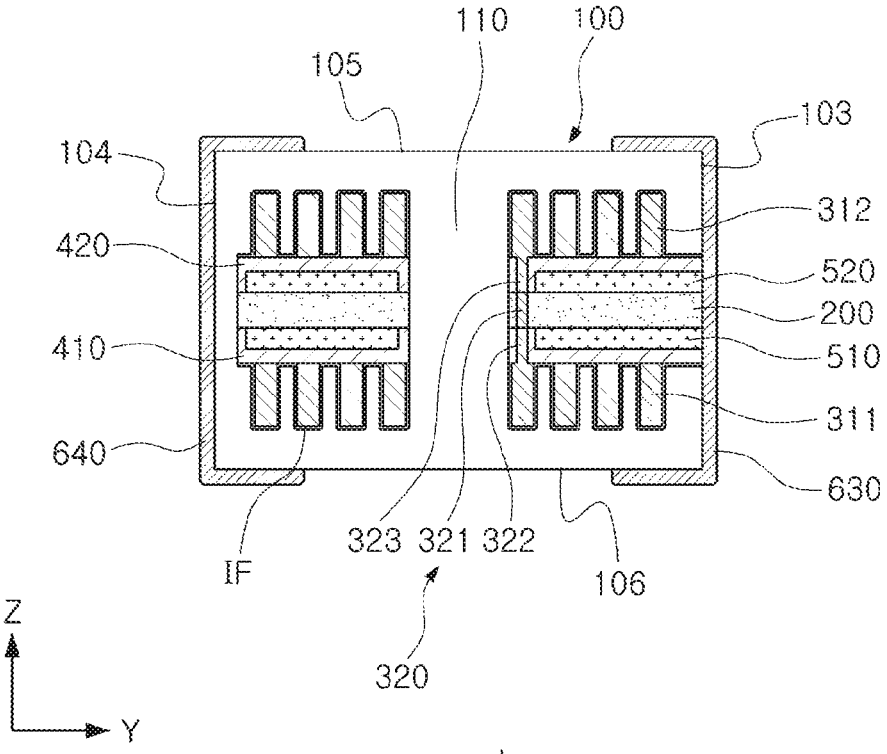
FIG. 24 is a cross-sectional diagram taken along line VII-VII' in FIG. 22.
Figure 25:
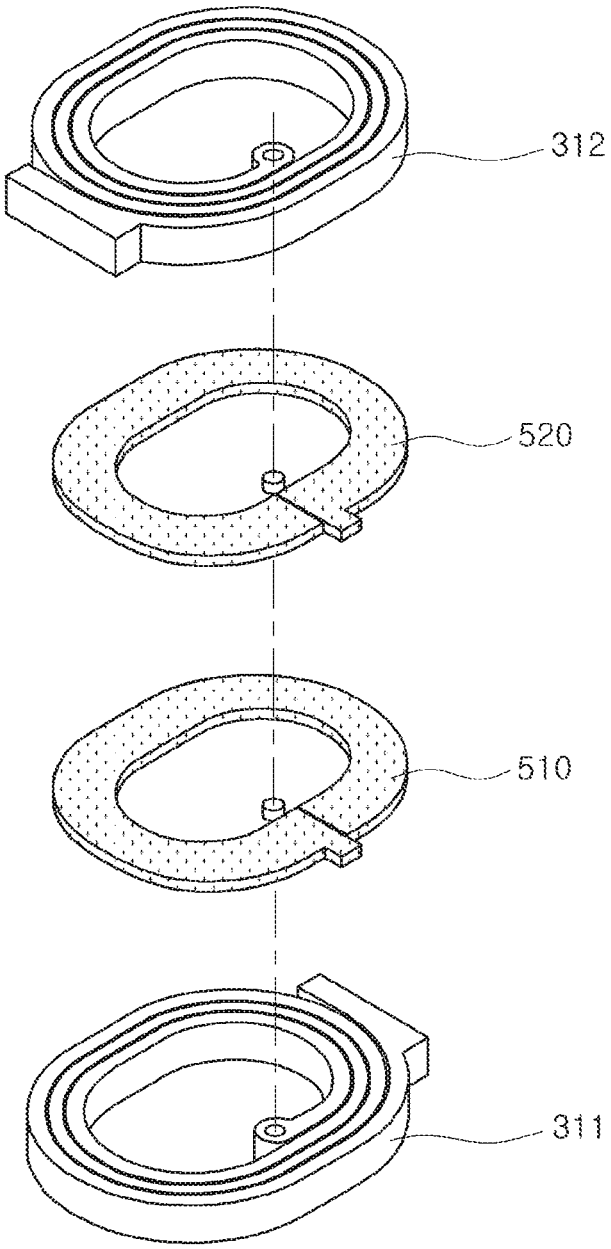
FIG. 25 is a diagram illustrating a connection relationship among a support substrate, a coil portion, and a noise removing portion according to another example embodiment.

FIG. 22 is a diagram illustrating a coil component according to another example embodiment. FIG. 23 is a cross-sectional diagram taken along line VI-VI' in FIG. 22. FIG. 24 is a cross-sectional diagram taken along line VII-VII' in FIG. 22. FIG. 25 is a diagram illustrating a connection relationship among a support substrate, a coil portion, and a noise removing portion according to another example embodiment. In FIGS. 22 and 25, an insulating layer applied to the example embodiment is not illustrated to clearly represent combinations between the elements.

Referring to FIGS. 1 to 4 and FIGS. 22 to 25, in a coil component 4000, a dispositional relationship among a coil portion 300, a noise removing portion 500, a first insulating layer 410, and a second insulating layer 420 may be different from that of the coil portion 300 and the noise removing portion 500 of the coil component 1000 described in the aforementioned example embodiment. Thus, in the example embodiment, only a dispositional relationship among the coil portion 300, the noise removing portion 500, the first insulating layer 410, and the second insulating layer 420 will be described. The descriptions of the other elements in the example embodiment may be the same as the descriptions of the elements in the aforementioned example embodiment.

Referring to FIGS. 22 to 25, the noise removing portion 500 in the example embodiment may be disposed between the coil portion 300 and the support substrate 200.

For example, a first noise removing pattern 510 may be in contact with and formed on a lower surface of a support substrate 200, the first coil pattern 311 may be disposed on the first noise removing pattern 510, and a first insulating layer 410 may be disposed between the first noise removing pattern 510 and the first coil pattern 311 and may electrically connect the first noise removing pattern 510 and the first coil pattern 311 to each other, in the direction indicated in FIGS. 22 to 25. The second noise removing pattern 520 may be in contact with and formed on an upper surface of the support substrate 200, a second coil pattern 312 may be disposed on the second noise removing pattern 520, and a second insulating layer 420 may be disposed between the second noise removing pattern 520 and the second coil pattern 312 and may electrically insulate the second noise removing pattern 520 and the second coil pattern 312 from each other. A via 320 connecting the first and second coil patterns 311 and 312 to each other may include a first via 321 penetrating the support substrate 200, a second via 322 penetrating the first insulating layer 410, and a third via 323 penetrating the second insulating layer 420. The second and third vias 322 and 323 may penetrate the first and second insulating layers 410 and 420 and may be in contact with and connected to both ends of the first via 321. The second and third vias 322 and 323 may be spaced apart from the first and second noise removing patterns 510 and 520.

The first to third vias 321, 322, and 323 may be formed in different processes, and a boundary may be formed among the vias. The first to third vias 321, 322, and 323 may also be formed in the same process and may be integrated with one another. When the first to third vias 321, 322, and 323 are formed in different processes, the second via 322 penetrating the first insulating layer 410 may cover one end of the first via 321 on which a seed layer penetrates the support substrate 200. The third via 323 penetrating the second via 322 may cover the other end of the first via 321 on which a seed layer penetrates the support substrate 200. Accordingly, the seed layers of the second and third vias 322 and 323 may be interposed between electroplating layers of the first to third vias 321, 322, and 323, a boundary may be formed between the electroplating layers of the first to third vias 321, 322, and 323. When the first to third vias 321, 322, and 323 are formed in the same process, a seed layer may be formed on an internal wall of a via hole penetrating the first insulating layer 410, the support substrate 200, and the second insulating layer 420, and the via hole may be filled with an electroplating layer. In this case, the first to third vias 321, 322, and 323 may be distinguished from one another by a dispositional region, rather than being distinguished from one another by an interfacial surface therebetween, differently from the above-described process. In both the processes, the seed layer and the electroplating layer of the second via 322 may be integrated with the seed layer and the electroplating layer of the third via 323, respectively, but an example embodiment thereof is not limited thereto. Similarly, the seed layer and the electroplating layer of the third via 323 may be integrated with a seed layer and an electroplating layer of the second coil pattern 312, respectively, but an example embodiment thereof is not limited thereto.

FIG. 24 illustrates an example in which diameters of the second and third vias 322 and 323 may be the same in upper and lower portions of the second and third vias 322 and 323, but an example embodiment thereof is not limited thereto. As an example, although not limited thereto, to form the second and third vias 322 and 323, the second and third vias 322 and 323 may be formed such that diameters of the second and third vias 322 and 323 may decrease in a direction of the other surfaces of the first and second insulating layers 410 and 420 in contact with the support substrate 200 from one surfaces of the first and second coil patterns 311 and 312 in contact with the first and second coil patterns 311 and 312 using a process for forming a via hole in the first and second insulating layers 410 and 420. Also, FIG. 24 illustrates an example in which both ends of the first via 321 taken in the thickness direction Z of the body 100 may be directly in contact with one ends of the second and third vias 322 and 323, respectively, but an example embodiment thereof is not limited thereto. As an example, although not limited thereto, via pads spaced apart from the first and second noise removing patterns 510 and 520 may be formed on both surfaces of the support substrate 200, and the first to third vias 321, 322, and 323 may be in contact with and interconnected to the via pads, respectively. By including the via pads, connection reliability among the first to third vias 321, 322, and 323 may be secured. A diameter of the via pad may be greater than a diameter of each of ends of the second and third vias 322 and 323 in contact with the via pad, but an example embodiment thereof is not limited thereto. Also, FIG. 24 illustrates an example in which centers of the first to third vias 321, 322, and 323 may match, but an example embodiment thereof is not limited thereto. A via 320 may be configured as a staggered via such that centers of the first to third vias 321, 322, and 323 may not match.

In the example embodiment, differently from the aforementioned example embodiments, the noise removing portion 500 may be formed on the support substrate 200, and the coil portion 300 may be formed on the noise removing portion 500. As the coil portion 300 has a relatively high aspect ratio, when the insulating layers 410 and 420 are disposed on the coil portion 300, it may be difficult to planarize surfaces of the insulating layers 410 and 420, and accordingly, it may be difficult to dispose the noise removing portion 500 on the insulating layers 410 and 420. In the example embodiment, to address the above-described issue, the noise removing portion 500 having a relatively simplified pattern shape and having a low aspect ratio may be preferentially formed on the support substrate 200.

Although not illustrated, the example embodiment may also be modified as the aforementioned example embodiments.

According to the aforementioned example embodiments, noise may be easily removed.

While the exemplary embodiments have been shown and described above, it will be apparent to those skilled in the art that modifications and variations could be made without departing from the scope of the present invention as defined by the appended claims.

What is claimed is:

1. A coil component, comprising:

a body;

a support substrate buried in the body;

a coil portion disposed on at least one surface of the support substrate and having both ends exposed from the body;

a noise removing portion disposed on the at least one surface of the support substrate, spaced apart from the coil portion, and having an open loop such that one end of the noise removing portion is exposed from the body;

an insulating layer disposed between the coil portion and the noise removing portion;

first and second external electrodes disposed on the body and connected to both ends of the coil portion, respectively; and a third external electrode disposed on the body and connected to the one end of the noise removing portion.

2. The coil component of claim 1, wherein the noise removing portion is disposed to correspond to a region in which the coil portion is disposed.

3. The coil component of claim 1, wherein the noise removing portion has a ring shape including a slit.

4. The coil component of claim 1, wherein the slit separates the one end of the noise removing portion and another end of the noise removing portion from each other.

5. The coil component of claim 1, wherein each of the coil portion and the noise removing portion has a planar spiral form.

6. The coil component of claim 5, wherein the coil portion and the noise removing portion have the same coiling direction from an innermost turn to an outermost turn.

7. The coil component of claim 1, further comprising:

an insulating film disposed along a surface of the coil portion and disposed between the coil portion and the insulating layer.

8. The coil component of claim 1, further comprising:

an insulating film disposed along a surface of the noise removing portion and disposed between the noise removing portion and the body.

9. The coil component of claim 1, wherein the coil portion includes first and second coil patterns disposed on both surfaces of the support substrate opposing each other, respectively, and each having a planar spiral form, and wherein the noise removing portion includes first and second noise removing patterns disposed on the first and second coil patterns, respectively, and each having an open loop.

10. The coil component of claim 9, wherein at least one of the first and second noise removing patterns has a ring shape including a slit.

11. The coil component of claim 9, wherein at least one of the first and second noise removing patterns has a planar spiral form.

12. The coil component of claim 9, further comprising:

a fourth external electrode disposed on a surface of the body and spaced apart from the first to third external electrodes, wherein one end of the first noise removing pattern is connected to the third external electrode, and wherein one end of the second noise removing pattern is connected to the fourth external electrode.

13. The coil component of claim 12, wherein the third external electrode and the fourth external electrode are in contact with and connected to each other on another surface of the body.

14. The coil component of claim 12, wherein the body has one surface and another surface opposing each other, front and rear surfaces connecting the one surface and the another surface and opposing each other, and side surfaces connecting the front and rear surfaces of the body and opposing each other, wherein the first and second external electrodes are disposed on the front and rear surfaces of the body, respectively, and wherein the third and fourth external electrodes are disposed on the side surfaces of the body, respectively.

15. The coil component of claim 9, further comprising:

a fourth external electrode disposed on a surface of the body and spaced apart from the first to third external electrodes, wherein the first and second noise removing patterns are connected to the third external electrode, and wherein the fourth external electrode is spaced apart from the coil portion and the first and second noise removing patterns.

16. The coil component of claim 9, further comprising:

a fourth external electrode disposed on a surface of the body and spaced apart from the first to third external electrodes, wherein among the third and fourth external electrodes, the first noise removing pattern is connected to only the third external electrode, and wherein among the third and fourth external electrodes, the second noise removing pattern is connected to only the fourth external electrode.

17. The coil component of claim 1, wherein the noise removing portion includes first and second noise removing patterns disposed on surfaces of the support substrate opposing each other, respectively, and each having an open loop, and wherein the coil portion includes first and second coil patterns disposed on the first and second noise removing patterns, respectively, and each having a planar spiral form, and the coil portion further includes a via penetrating the insulating layer and the support substrate to connect the first and second coil patterns.

18. The coil component of claim 1, wherein the noise removing portion is composed of a conductive material.

19. A coil component, comprising:

a body and a support substrate buried in the body;

a coil portion disposed on at least one surface of the support substrate and including a coil pattern having a planar spiral form;

a noise removing portion disposed on at least one surface of the support substrate, spaced apart from the coil portion, and including an open loop with a slit;

an insulating layer disposed between the coil portion and the noise removing portion;

first and second external electrodes disposed on a surface of the body and connected to both ends of the coil portion, respectively; and a third external electrode disposed on another surface of the body and connected to one end of the noise removing portion.

20. A coil component, comprising:

a body and a support substrate buried in the body;

a coil portion disposed on at least one surface of the support substrate and including a coil pattern having a planar spiral form;

a noise removing portion having a planar spiral form, disposed on at least one surface of the support substrate, and spaced apart from the coil portion;

an insulating layer disposed between the coil portion and the noise removing portion;

first and second external electrodes disposed on a surface of the body and connected to both ends of the coil portion, respectively; and a third external electrode disposed on another surface of the body and connected to one end of the noise removing portion.

21. The coil component of claim 20, wherein each of the coil pattern and the noise removing portion has a plurality of turns, and wherein the coil pattern and the noise removing portion have the same coiling direction from an innermost turn to an outermost turn.

22. A coil component, comprising:

a body;

a coil portion embedded in the body and having an end exposed from the body;

a noise removing portion embedded in the body and spaced apart from the coil portion, the noise removing portion having an open loop including a first end exposed from the body and a second end embedded in the body;

a first external electrode disposed on the body and connected to the end of coil portion; and a second external electrode disposed on the body and connected to the first end of the noise removing portion.

23. The coil component of claim 22, wherein the noise removing portion is exposed from the body only through the first end.

24. The coil component of claim 22, wherein the noise removing portion includes a slit.

25. The coil component of claim 24, wherein the slit separates the first and second ends from each other.

26. The coil component of claim 22, wherein each of the coil portion and the noise removing portion has a planar spiral form.

27. A coil component, comprising:

a magnetic body;

a coil portion embedded in the magnetic body and having ends exposed from the magnetic body;

an insulating layer embedded in the magnetic body;

a noise removing portion embedded in the magnetic body and spaced apart from the coil portion;

an insulating layer disposed between the coil portion and the noise removing portion;

first and second external electrodes disposed on the magnetic body and connected to the ends of the coil portion, respectively; and a third external electrode disposed on the magnetic body and connected to one end of the noise removing portion, wherein the noise removing portion is in direct contact with the insulating layer.

28. The coil component of claim 27, wherein the noise removing portion has an open loop such that the one end of the noise removing portion is exposed from the magnetic body.

29. The coil component of claim 27, further comprising:

a support substrate buried in the body, wherein the noise removing portion is disposed between the support substrate and the insulating layer.

30. The coil component of claim 27, further comprising:

a support substrate buried in the body, wherein the insulating layer is disposed between the support substrate and the noise removing portion.

* * * * *